US006527583B2

(12) United States Patent
Plate

(10) Patent No.: US 6,527,583 B2
(45) Date of Patent: Mar. 4, 2003

(54) ELECTRICAL PLUG-AND-SOCKET CONNECTOR HAVING CONNECTABLE SOCKET HOUSINGS

(75) Inventor: Herbert Plate, Ludenscheid (DE)

(73) Assignee: Leopold Kostal GmbH & Co., Ludenscheid (DE)

( * ) Notice: Subject to any disclaimer, the term of this patent is extended or adjusted under 35 U.S.C. 154(b) by 0 days.

(21) Appl. No.: 10/162,813

(22) Filed: Jun. 5, 2002

(65) Prior Publication Data

US 2002/0173198 A1 Nov. 21, 2002

Related U.S. Application Data

(63) Continuation of application No. PCT/EP01/03924, filed on Apr. 5, 2001.

(51) Int. Cl.[7] ..... H01R 3/00
(52) U.S. Cl. ..... 439/489; 439/157; 439/752
(58) Field of Search ..... 439/489, 752, 439/157

(56) References Cited

U.S. PATENT DOCUMENTS 5,464,353 A 11/1995 Saijo et al. ..... 439/489
5,509,829 A 4/1996 Saba ..... 439/752
5,562,486 A 10/1996 Saijo et al. ..... 439/489
6,004,158 A * 12/1999 Ward ..... 439/595
6,123,559 A * 9/2000 Murakami et al. ..... 439/157
6,358,102 B1 * 3/2002 Fukamachi ..... 439/752

* cited by examiner

*Primary Examiner*—Lynn D. Feild
*Assistant Examiner*—Michael C. Zarroli
(74) *Attorney, Agent, or Firm*—Brooks & Kushman, P.C.

(57) ABSTRACT

An electrical plug-and-socket connection part includes socket housings which assemble together to form the plug-and-socket connection part. Each socket housing includes longitudinally extending compartments for holding contact elements. Each socket housing has an associated locking bar arranged to slide in a direction transverse to the compartments for locking the contact elements in the compartments. Upon the socket housings being connected with one another the locking bars engage with one another such that locking motion of one of the locking bars is transferred to the other locking bars. The locking bars may be fixed in a preliminary latched position against their respective socket housings before the socket housings are connected together. One of the socket housings may include an unlocking mechanism for removing the locking bar of an adjacent socket housing from the preliminary latched position against the adjacent socket housing after the socket housings have been connected together.

13 Claims, 4 Drawing Sheets

ELECTRICAL PLUG-AND-SOCKET CONNECTOR HAVING CONNECTABLE SOCKET HOUSINGS

CROSS-REFERENCE TO RELATED APPLICATIONS

This is a continuation of International Application PCT/EP01/03924, published in German, with an international filing date of Apr. 5, 2001.

BACKGROUND OF THE INVENTION

1. Field of the Invention

The invention concerns an electrical plug-and-socket connection part with compartments, each of which is intended to hold one contact element, and with a locking bar which can slide in the direction transverse to the longitudinal extension of the compartments to lock the contact elements in the compartments.

2. Background Art

Electrical connection parts usually include a housing having a socket housing arranged in the housing. The socket housing has compartments extending longitudinally in it, which are arranged in it according to a specified grid. These compartments hold electrical contact elements. The electrical contact elements can be in the form of either socket or plug elements. A locking bar locks the contact elements in the compartments of the socket housing. The locking bar is mounted in the socket housing so that it can slide transverse to the longitudinally extending chambers and thus to the contact elements which extend longitudinally when they are inserted in the compartments.

A single locking bar locks all of the individual contact elements in the compartments. To do this, such a locking bar has several shoulders, which are all separated from one another by non-locking sections of the locking bar. When the socket housing is in the position for inserting the contact elements, each compartment is tangentially bordered by such a section of the locking bar which has no locking shoulder arranged in it.

After the contact elements are inserted in the socket housing, the locking bar is moved in the direction transverse to the socket housing to lock the contact elements contained in the compartments, which inserts the locking shoulders into the compartments and into the corresponding recesses in the contact elements. This keeps the contact elements locked in the socket housing. Before insertion, the locking bar is normally in a preliminary latched position to ensure that insertion into the compartments is not prevented by locking shoulders engaging into the compartments. The locked position of the locking bar is also fixed by a latching mechanism. The final latched position simultaneously signals to a person undertaking assembly that the locking bar is in its intended locked position.

Such electrical plug-and-socket connection parts are frequently used. For example, such plug-and-socket connection parts are used in motor vehicles to attach control units. Such a control unit could be, for example, an engine control unit. Such a control unit normally requires that many different plug-and-socket connectors make contact with it. These plug-and-socket connectors often have a different grid dimension and also a different locking height. It is also possible for the contact elements that are used to have different exposed cross sectional surface for electrical current transfer. Thus, in order to make contact with such a control unit, it is necessary to make several plug-and-socket connections.

To simplify such assembly, the transition has already been made to use a plug-and-socket connection part which virtually represents a physical connection of two individual plug-and-socket connection parts whose compartments have different grid dimensions. Such a combined plug-and-socket connection part reduces the attachment effort by one step. However, after the contact elements have been inserted in the socket housing it is necessary to activate two diametrically opposite locking bars to lock the compartments. Since the height of such a control unit is normally limited, this principle only allows plug-and-socket connectors with a maximum of two different socket housings to be combined lying next to one another.

SUMMARY OF THE INVENTION

Therefore, starting from the prior art discussed above, the invention is based on the task of further developing an electrical plug-and-socket connection part of the type mentioned above in such a way that it not only reduces the effort involved in bringing about the intended locking, but also makes it possible to lock more than two socket housings, especially different ones, with a single locking motion.

This task is solved according to the invention as the plug-and-socket connection part has at least two individual socket housings. The at least two individual socket housings can be connected with one another to form the plug-and-socket connection part. Each socket housing has a number of compartments arranged in it. Each compartment being intended to hold a contact element. Each individual socket housing has its own locking bar to lock the contact elements in the compartments. The locking bars of the socket housings are arranged so that they can slide in the same direction and so that, after the socket housings are assembled together to form the plug-and-socket connection part, the locking bars work together with one another such that the locking motion of the outermost accessible locking bar is transferred to the other locking bar(s).

The plug-and-socket connection part according to the invention comprises at least two socket housings. The socket housings can have the same or a different grid dimension and the same or a different locking height. The socket housings can be connected with one another. Each socket housing has its own locking bar to lock the contact elements arranged in the socket housing. The locking bars can slide in the same direction in the socket housings, and after the socket housings have been assembled with one another the locking bars are arranged to work together in such a way that the locking motion of an outer locking bar is transferred to the locking bar of the neighboring socket housing.

Such an arrangement not only has the advantage that it is possible to put all locking bars of the plug-and-socket connection part in their locked position by a single locking action, but also especially that only one locking bar has to be freely accessible from the outside so that it can be moved. In principle, the other locking bars, which are coupled with the motion of the outer locking bar at least with regard to a locking motion, do not need to be accessible from the outside, so that such a plug-and-socket connection part can also have a socket housing which is not accessible from outside. For example, such a plug-and-socket connection part can comprise three or even more socket housings lying next to one another.

In principle, it is necessary that a transfer of motion is only ensured from the outer locking bar to the inner locking bars when there is a locking motion. However, it is expedient to arrange the cooperating locking bars in such a way that they are engaged with one another, in order to make the connection of the individual locking bars with one another rigid with respect to pushing and pulling. The individual socket housings can then also be unlocked once again by moving the outside locking bar if it is necessary to change the contact elements. This connection, which is rigid with respect to pushing and pulling, can be accomplished by a precisely fitting engagement of two locking bars, so that the same motion of the outer locking bar is transferred to the neighboring bar.

However, it is also possible for such a connection, which is rigid with respect to pushing and pulling, to have a certain amount of play, in the case when a greater distance has to be covered with the outer locking bar to bring about the intended locking than does with the neighboring locking bar. The use of connection members that are bent at right angles also makes it possible in principle to bring about a connection of locking bars in different planes.

A preferred embodiment provides that before the locking bars of the individual socket housings are assembled with one another, they are held in a preliminary latched position. The preliminary latched position fixes the open position of the locking bars. It is expedient for each neighboring socket housing to have means of unlocking assigned to it, which, if two neighboring socket housings are assembled to one another, loosen or undo the preliminary latched position of the inner locking bar, if it is engaged with the outer locking bar. Thus, the preliminary latched position of the inner locking bar is undone, while this preliminary latched position is also maintained by the outer locking bar, which is in the preliminary latched position.

BRIEF DESCRIPTION OF THE DRAWINGS

The invention is described below using a preferred sample embodiment with reference to the attached figures. The figures are as follows.

DETAILED DESCRIPTION OF THE PREFERRED EMBODIMENT(S)

Figure 1:
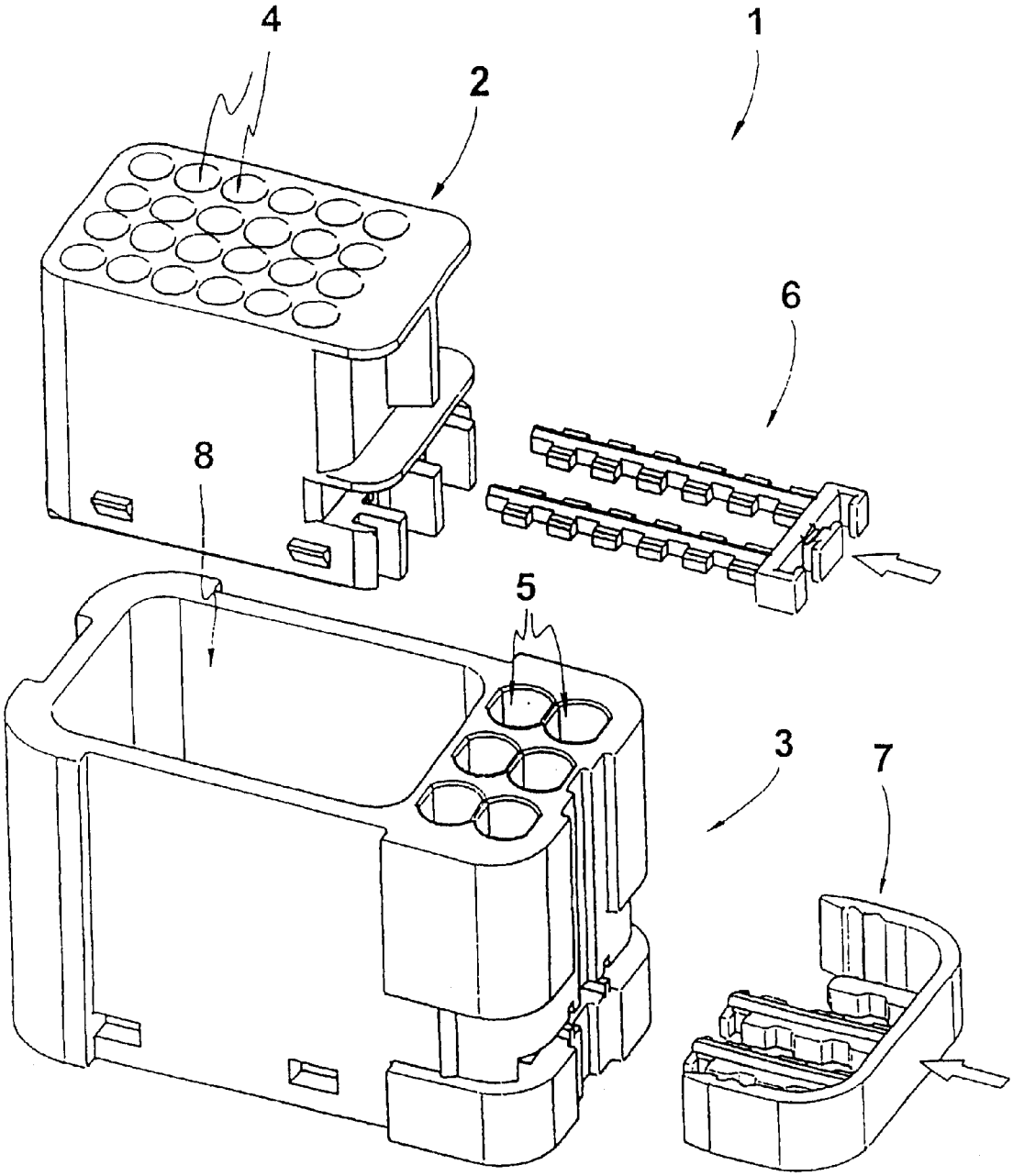
FIG. 1 illustrates a plug-and-socket connection part with two socket housings, shown in an exploded view.

FIG. 1 illustrates an electrical plug-and-socket connection part 1 having two socket housings 2, 3. Each socket housing 2, 3 have a certain number of compartments 4, 5 to hold electrical contact elements, for example female insert contacts. Each socket housing 2, 3 has a locking bar 6, 7 to lock the contact elements inserted in the compartments 4, 5. Socket housing 3 is made so that it simultaneously forms a housing for the socket housing 2. For this purpose, adjacent to the arrangement of compartments 5 in socket housing 3 there is a receptacle 8 to hold socket housing 2 along with locking bar 6. Locking bars 6, 7 are mounted so that they can slide in socket housings 2, 3 in the plane shown in FIG. 1 by the arrows.

It should be pointed out that the grid dimension of the arrangement of compartments 4 in socket housing 2 is different from that of compartments 5 of socket housing 3.

Figure 2B:
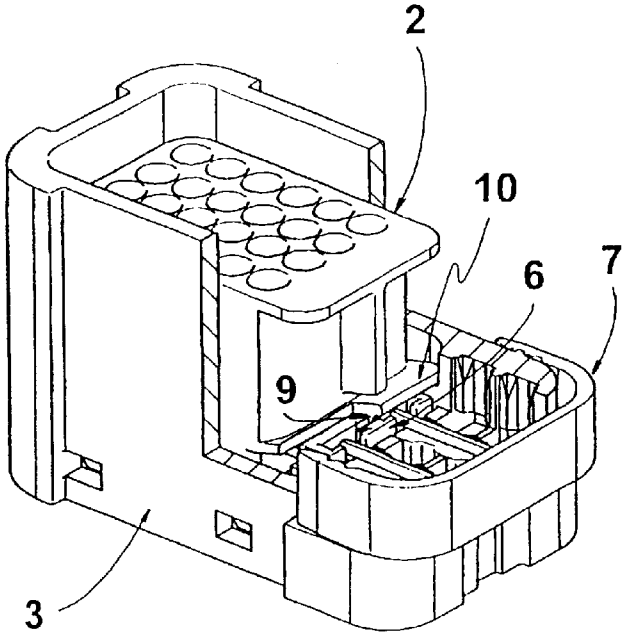
FIG. 2*b* illustrates the plug-and-socket connection part shown in FIG. 2*a,* with the two socket housings connected together with their locking bars in preliminary latched position.
Figure 2A:
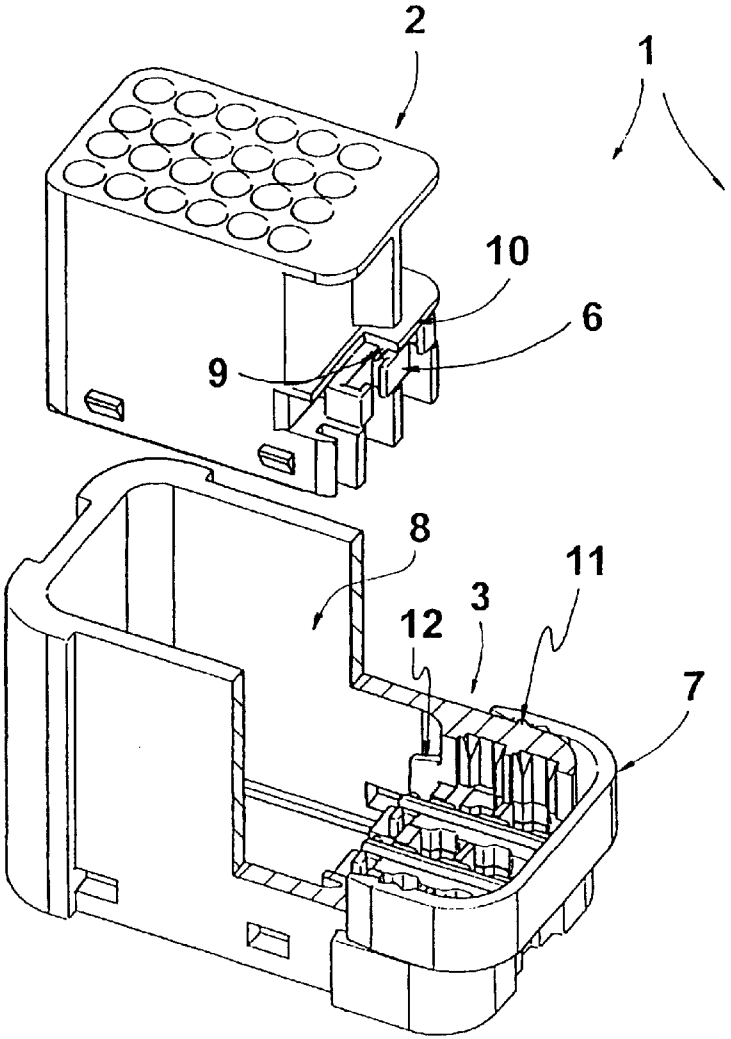
FIG. 2*a* illustrates the plug-and-socket connection part in FIG. 1, partially cut away in preassembled position.

FIG. 2*a* shows plug-and-socket connection part 1 with locking bars 6, 7 inserted into the respective socket housing 2, 3. Locking bars 6, 7 are held in a preliminary latched position before assembly of the contact elements. For this purpose, in preliminary latched position the top side of locking bar 6 is engaged by a latching bulge 9 projecting downward from a step 10 of socket housing 2. Step 10 is materially elastic in the vertical direction so that if there is sufficient counterpressure the preliminary latched position of locking bar 6 can be undone. Locking bar 7 engages around the outside of socket housing 3 with two clamping legs and is held in its preliminary latched position by latching bulges 11 which engage into the inside of the two arms of locking bar 7. The two socket housings 2, 3 are put together in this preassembled position of each of locking bars 6, 7 relative to the respective socket housing 2, 3 by inserting socket housing 2 into receptacle 8.

To unlock the preliminary latched position of locking bar 6 in socket housing 2, socket housing 3 always has one unlocking fin 12. Unlocking fin 12 comes to lie against the bottom of step 10 when the two socket housings 2, 3 are put together and which moves it vertically upward until latching bulge 9 comes out of the latching depression of locking bar 6 to unlock locking bar 6. The assembled position of the two socket housings 2, 3 is shown in FIG. 2*b*. To hold socket housing 2 in receptacle 8 of socket housing 3, socket housing 2 has latching "noses" on the outside, which engage in corresponding recesses in socket housing 3.

Figure 3A:
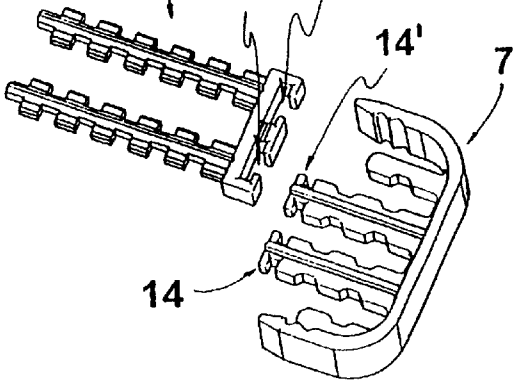
FIG. 3*a* illustrates the locking bars of the two socket housings before the socket housings are assembled.
Figure 3B:
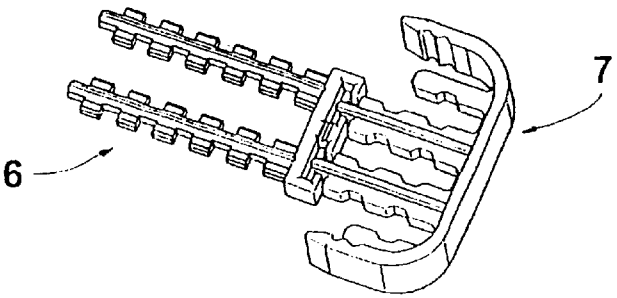
FIG. 3*b* illustrates the locking bars shown in FIG. 3*a* engaged with one another.

When the two socket housings 2, 3 are put together, the two locking bars 6, 7 are also positively engaged with one another in the sliding direction. The two locking bars 6, 7 are shown in FIG. 3*a* before the two socket housings 2, 3 are put together. Locking bar 6 has on its end facing locking bar 7, two C-shaped grooves 13, 13', arranged parallel to one another, each of which has a hammer-shaped head 14, 14' of locking bar 7 engage into it by a vertical assembly motion after socket housings 2, 3 are put together. This engaged with one another position of the two locking bars 6, 7 is shown in FIG. 3*b*. The heads 14, 14' are held in a precise fit in grooves 13, 13', so that a movement of locking bar 7, which is accessible from outside, is transferred equally to locking bar 6, which is inaccessible from outside. This applies both for a locking motion of locking bar 7 and for an unlocking motion of locking bar 7.

Figure 4A:
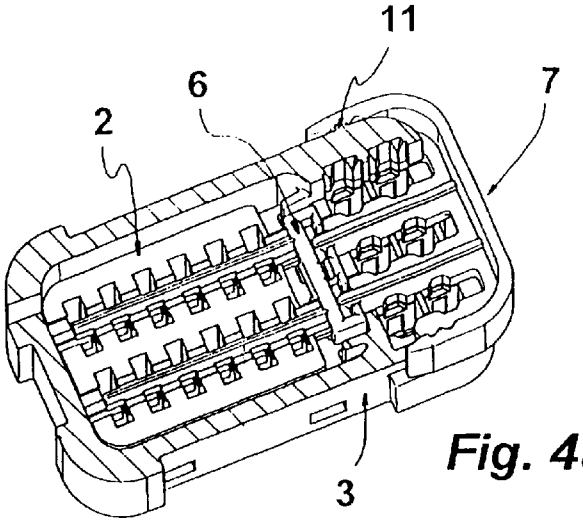
FIG. 4*a* illustrates a section through the plug-and-socket connection part shown in FIG. 3*b* parallel to the sliding plane of the locking bars, with the two locking bars in their preliminary latched position.
Figure 4B:
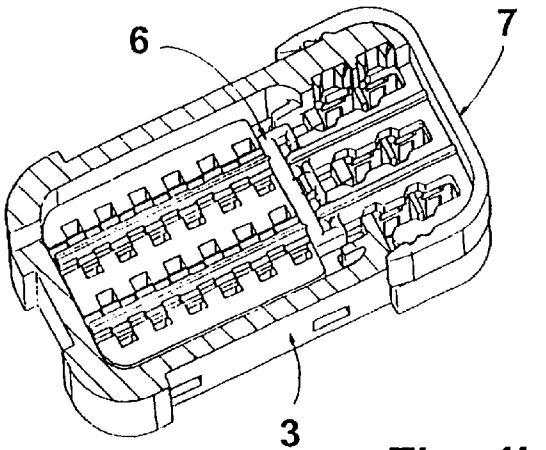
FIG. 4*b* illustrates the sectional presentation of FIG. 4*a* with the locking bars in their locked position.

The assembled locking bars 6, 7 in the respective socket housings 2, 3 are shown, in the sectional presentation in FIG. 4*a,* in their preliminary latched position. This illustration also shows that because locking bar 6 is coupled to locking bar 7 in such a way that the coupling is rigid with respect to pushing and pulling, locking bar 6 is also held in the preliminary latched position by the latching of locking bar 7 against latching bulges 11, despite the loosening of its preliminary latched position in socket housing 2. After contact elements are inserted in socket housings 2, 3, locking bar 7 is pushed into socket housing 3, so that the contact elements held in compartments 4, 5 are locked in. Moving locking bar 7 produces an identical movement of locking bar 6, so that to lock the contact elements of the two socket housings 2, 3 it is only necessary to perform a single locking motion.

Figure 5:
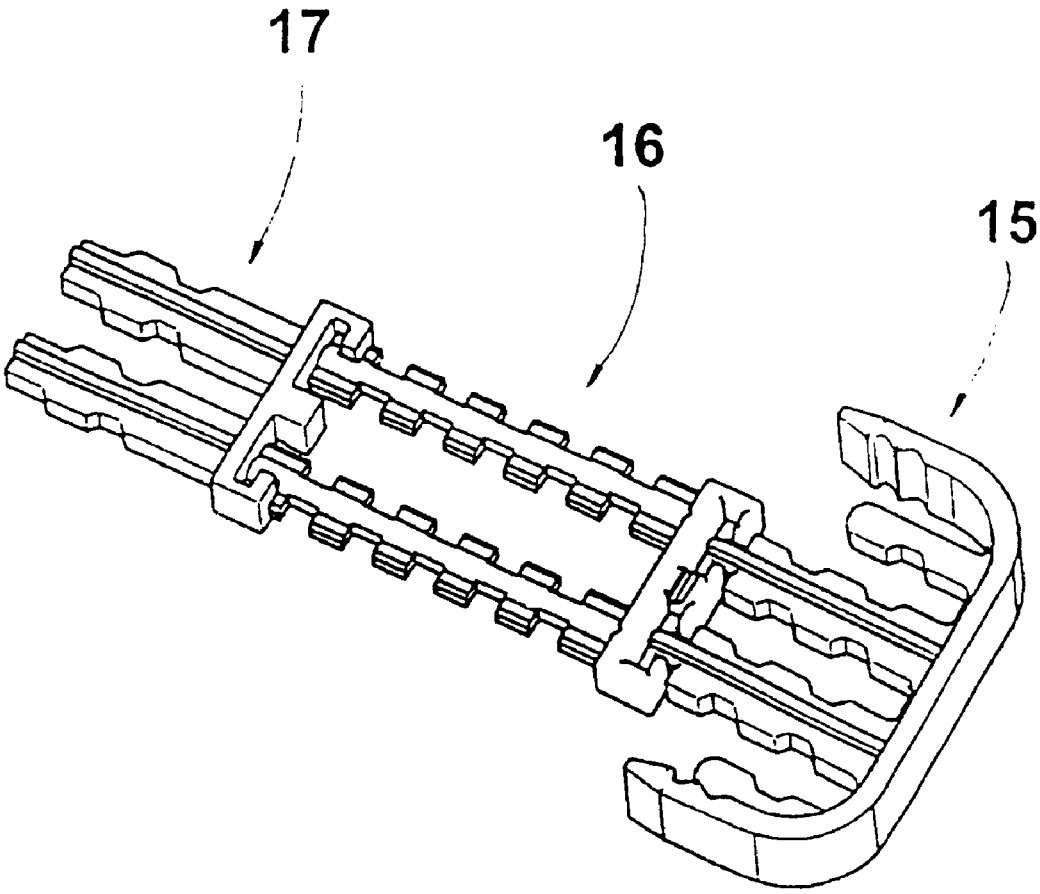
FIG. 5 illustrates the locking bars of another plug-and-socket connection part engaged together.

This principle of attaching more locking bars to a locking bar that is accessible and operable from outside makes it possible to form plug-and-socket connection parts that have several different socket housings which should be locked with a single locking motion. This applies especially for such socket housings whose compartments are arranged with a different grid dimension. For example, FIG. 5 shows the locking bars 15, 16, 17 of another plug-and-socket connector, which engage with one another after assembly of the individual socket housings.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical plug-and-socket connection device comprising:

at least two socket housings which are connectable with one another and each having a plurality of longitudinally extending compartments for holding respective contact elements; and at least two locking bars each associated with a respective one of the at least two socket housings, the at least two locking bars being arranged to slide in a direction transverse to the longitudinally extending compartments for locking the contact elements in the compartments, wherein upon the at least two socket housings being connected with one another the at least two locking bars engage with one another such that locking motion of one of the at least two locking bars is transferred to the other of the at least two locking bars.

2. The device of claim 1 wherein:

the one of the at least two locking bars engages with the other of the at least two locking bars to transfer a push and pull motion.

3. The device of claim 1 further comprising:

fasteners for engaging the at least two locking bars with one another.

4. The device of claim 1 further comprising:

latches for fixing the at least two locking bars in a preliminary latched position against their respective one of the at least two socket housings prior to the at least two socket housings being connected together.

5. The device of claim 4 wherein:

at least one of the at least two socket housings includes unlocking means operable for removing the locking bar of an adjacent socket housing from the preliminary latched position against the adjacent socket housing after the at least two socket housings are connected together.

6. A plug-and-socket connection device comprising:

first and second socket housings which are interconnectable with one another, the first and second socket housings each having a plurality of longitudinally extending compartments for holding respective contact elements; and first and second locking bars each respectively associated with the first and second socket housings, the first and second locking bars being arranged to slide in a direction transverse to the longitudinally extending compartments for locking the contact elements in the compartments, wherein upon the first and second socket housings being interconnected with one another the first and second locking bars engage with one another such that locking motion of the second locking bar is transferred to the first locking bar, wherein upon the first and second socket housings being interconnected with one another the first and second locking bars are operable with one another such that unlocking motion of the second locking bar is transferred to the first locking bar.

7. The device of claim 6 wherein:

the first and second locking bars slide in the direction transverse to the longitudinally extending compartments in different planes.

8. The device of claim 7 further comprising:

connection members bent at substantially right angles for engaging the first and second locking bars with one another upon the first and second socket housings being connected with one another.

9. The device of claim 6 wherein:

the first socket housing and the first locking bar are enclosed by a portion of the second socket housing when the first and second socket housings are interconnected with one another such that the first locking bar is unaccessible from direct contact.

10. The device of claim 6 wherein:

the first and second locking bars are fixed in a preliminary latched position against their respective first and second socket housings before the first and second housings are connected together.

11. The device of claim 10 wherein:

the second socket housing includes unlocking means operable for loosening the first locking bar from a preliminary latched position after the first and second socket housings are interconnected with one another.

12. A plug-and-socket connection device comprising:

at least three housings, wherein first and second ones of the housings are insertable within respective portions of a third one of the housings, the housings each having a plurality of compartments for holding respective elements; and at least three locking bars each associated with a respective one of the housings, the locking bars being arranged to slide together along the same direction for locking the elements in the compartments, wherein upon the first and second housings being inserted within the third housing the locking bars are operable with one another such that locking motion of one locking bar is transferred to the other locking bars.

13. The device of claim 12 wherein:

the locking bars are arranged to slide together along the same direction in the same plane for locking the elements in the compartments.

* * * * *